United States Patent [19]

Cagle

[11] 4,161,168

[45] Jul. 17, 1979

[54] FIREPLACE GRATE

[76] Inventor: Donald D. Cagle, P.O. Box 3349, Station A, Fort Smith, Ark. 72913

[21] Appl. No.: 872,909

[22] Filed: Jan. 27, 1978

[51] Int. Cl.[2] ..... F23H 13/00

[52] U.S. Cl. ..... 126/164; 126/121; D7/207

[58] Field of Search ..... 126/121, 164, 165; D7/207

[56] References Cited

U.S. PATENT DOCUMENTS

| | | | |
|---|---|---|---|
| 1,143,235 | 6/1915 | Shuping | 126/164 |
| 2,519,482 | 8/1950 | Kutchera | 126/165 |
| 2,843,109 | 7/1958 | Chapla | 126/165 |
| 2,926,657 | 3/1960 | Ford | 126/165 |
| 3,240,206 | 3/1966 | Schutt | 126/121 |
| 3,505,986 | 4/1970 | Wood | 126/165 |
| 3,508,536 | 4/1970 | McEwan | 126/165 |
| 3,612,034 | 10/1971 | Wood et al. | 126/165 |
| 4,010,729 | 3/1977 | Egli | 126/164 |
| 4,078,542 | 3/1978 | Young et al. | 126/164 |

*Primary Examiner*—Ronald C. Capossela
*Attorney, Agent, or Firm*—Albert H. Kirchner

[57] ABSTRACT

A new fireplace grate comprises a stationary open-front lower frame which is U-shaped in plan and has a rectangular grill movably mounted on it by a hinge connecting the superposed rear members of the grill and lower frame, thereby allowing the grill to be tilted up, with its front raised, to facilitate removal of ashes forwardly from the hearth. Log-supporting grate bars in laterally spaced parallelism have their ends removably seated in aligned slots in the front and rear members of the grill. In one embodiment the grate bars overlie in spaced protective relation an equal number of removable tubes having their rear ends detachably sleeved on nipples forwardly projecting from an air-supplying manifold which forms the rear member of the lower frame, with the front ends of the tubes removably bracketed in hangers depending from the front member of the grill and open for discharge of heated air.

12 Claims, 9 Drawing Figures

FIREPLACE GRATE

DESCRIPTION

BACKGROUND OF THE INVENTION

Household fireplaces have long been criticised as subject to numerous shortcomings, prominent among which are the difficulty of cleaning and keeping them clean of accumulated ashes and their notorious inefficiency in useful delivery of the heat of burning logs. Both of these defects are attributable to the conventional types of grate which necessarily include front cross bars providing upstanding abutments for holding the burning logs against rolling forward, and which include no means operating otherwise than by radiation for transmitting heat to the room space to be warmed. The frontal construction quite completely inhibits removal of ashes forwardly from the hearth while the grate remains in place, and reliance solely on radiation leaves the great bulk of the generated heat wasted by convection up the chimney.

Attempts at improving grate design to provide for proper log holding and at the same time facilitate easy ash removal have not been successful. Other efforts directed to conduction of heat to air in heat exchange tubes and convection therefrom into the room to be warmed have been equally unproductive, in most instances creating more problems than they solved, as by requiring frequent whole grate replacement because of early failure resulting from the burning out of such integral fixed components as air tubes, necessarily made of sheet metal thin enough for good conduction and thick enough to support burning logs of considerable weight.

SUMMARY OF THE INVENTION

The present invention provides fireplace grates embodying principles obviating the foregoing and other deficiencies.

In their simplest embodiment the new inventive principles are incorporated in a grate comprising two principal members: (1) a fixed lower frame that is U-shaped in plan, having a wide open front and a rear cross member connecting two side bars, and (2) a grill, rectangular in plan, hinged at its back to the rear cross bar of the lower frame, for movement from an operative log-supporting position bearing horizontally down on the rear member and side bars of the lower frame to an upwardly tilted position in which ashes may be removed forwardly from the hearth through the open front of the lower frame.

In a more complete application of the inventive principles the log-supporting grate bars of the grill lie over and heat an equal number of hollow tubes which heat air received from a manifold forming the rear cross member of the lower frame and deliver the air from their open front ends into the room space to be heated.

In both embodiments, and in others incorporating more or less of the new inventive principles, components that are susceptible to deterioration from long exposure to excessive heat are removable and replaceable at low cost,—far less than the expense of total replacement required in the case of conventional grates of the usual all-welded or otherwise integral construction.

Prior Art Statement under 37 CFR 1.97

The closest prior art of which the inventor is aware is U.S. Pat. No. 3,240,206, of Mar. 15, 1966, which discloses a fireplace grate of integrated one-piece construction having a rear manifold supplying air through forwardly extending tubes that are open at their front ends for discharge of air heated by burning logs that rest directly on the tubes.

SHORT DESCRIPTION OF THE DRAWINGS

In the accompanying drawings, which illustrate two embodiments of the invention which have been reduced to practice and found to give satisfactory results in achieving the foregoing and other objects, and hence are at present preferred:

DESCRIPTION OF THE PREFERRED EMBODIMENTS

Figure 1:
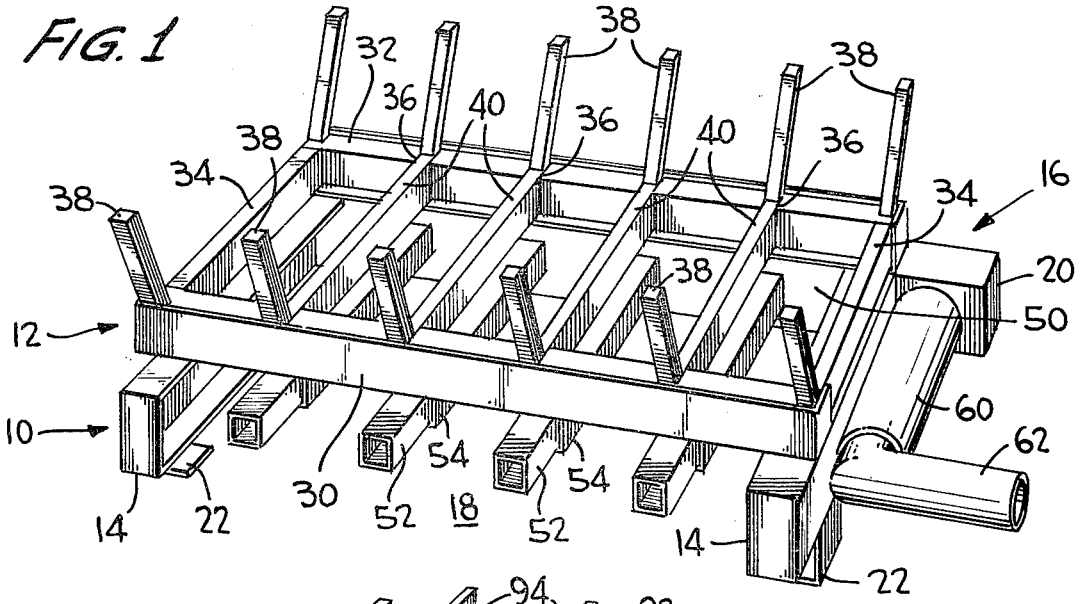
FIG. 1 is a perspective view of the new grate in a preferred, complete embodiment of the principles of the invention, showing the parts in operative position.

In the first and preferred embodiment of the invention, shown in FIGS. 1–7, the reference numeral 10 designates the lower frame element of the grate, and 12 the grill component which in operative position rests horizontally on the lower frame, as shown in FIG. 1. Each of these two principal parts of the structure is formed of suitable heavy iron or steel stock pieces welded together at their abutting ends. The lower frame is three-sided, being formed of two identical end members 14, 14, connected in parallelism at their rear ends to a rear member 16. The frame is thus U-shaped in plan, with a wide open front, as shown at 18.

For the purpose of rigidity and durability, the end members 14, 14 may be made of stout angle or channel stock as shown. The rear member 16 is likewise made of stout iron or steel stock, but in the FIGS. 1–7 embodiment this member is a tube of square cross-section, closed at both ends and projecting at one end slightly beyond its connection to the adjacent end member, as shown at 20. The lower frame members all present flat co-planar top surfaces which combine to provide a solid horizontal bearing surface for the grill 12, presently to be described, when the grate is set on a hearth floor, preferably slightly raised above the floor surface, as by short feet 22 welded to the frame members at the four corners of the frame.

The grill 12 is formed of four members welded together at their ends to constitute a frame that is fully rectangular in plan, closed at its front, rear and ends.

The front and rear members, designated 30 and 32 respectively, may each be made of a pair of angle elements welded together in box fashion (see FIG. 6) and welded at their ends to end members 34, which may be flat bars as shown. The front and rear members 30, 32 are each cut to provide a series of equally spaced slots 36 (see FIGS. 2 and 6). The slots of the two members are aligned in pairs, as shown, and the number of slots in each member may be of the order of six, as shown. The number is not critical.

Figure 2:
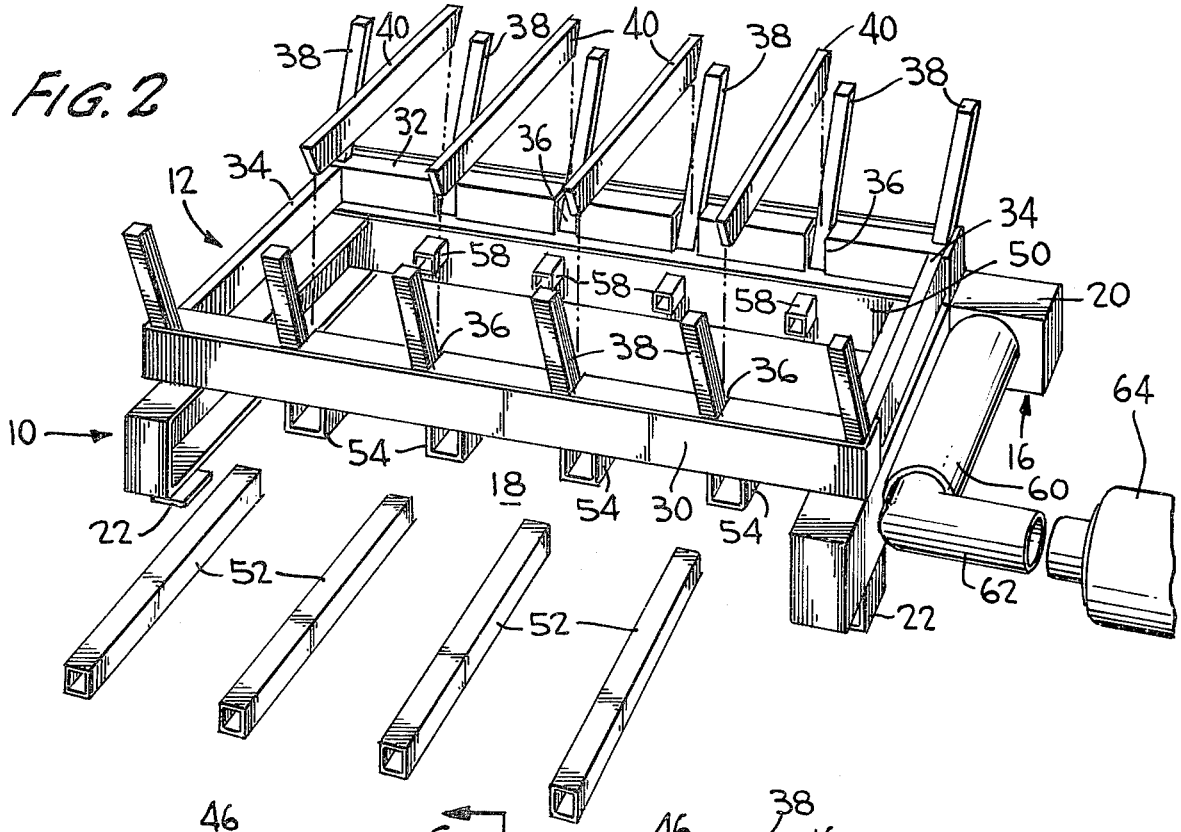
FIG. 2 is a perspective, exploded view of the same grate, showing the grill bars and tubes removed from operative position.
Figure 3:
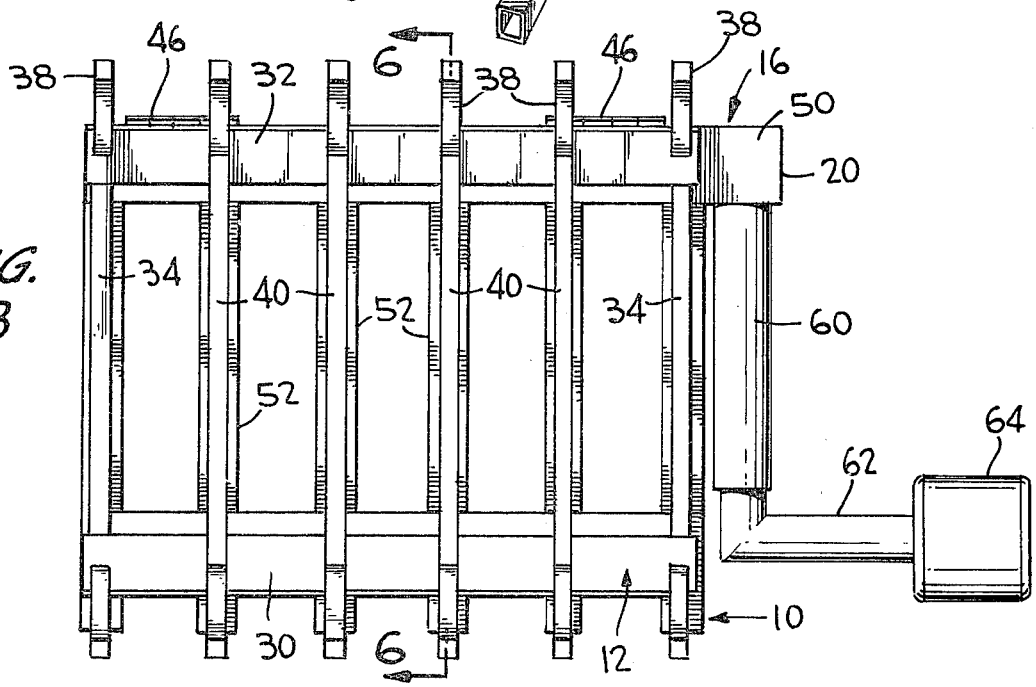
FIG. 3 is a top plan view of the grate shown in FIG. 1.
Figure 4:
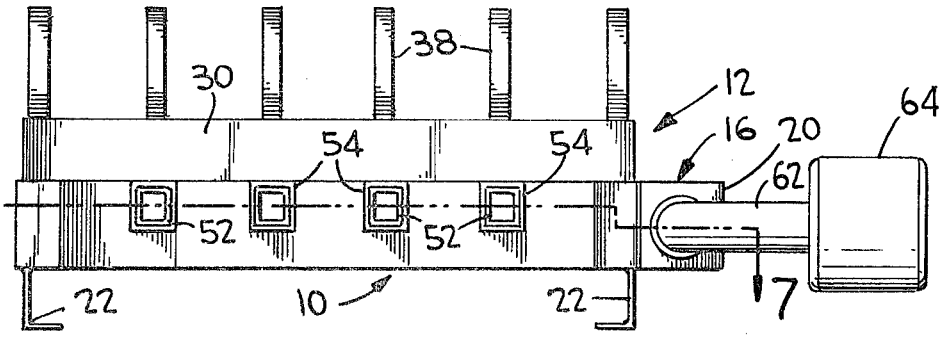
FIG. 4 is a front elevational view of the same grate.
Figure 6:
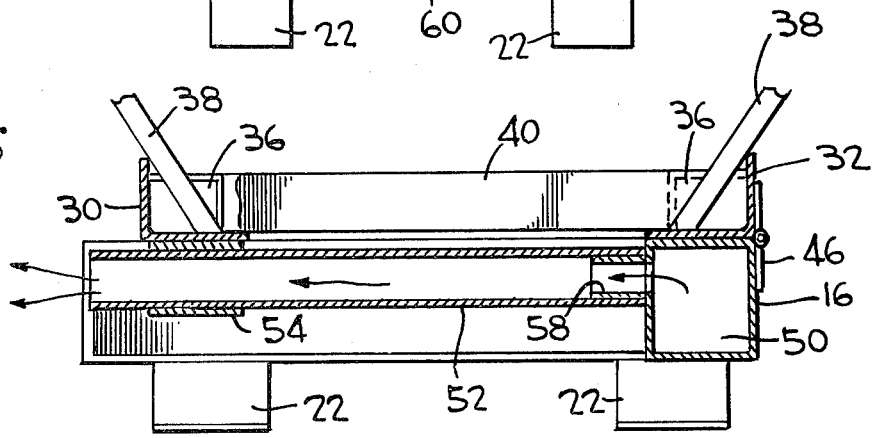
FIG. 6 is a vertical cross-sectional view taken on the line 6—6 of FIG. 3.
Figure 7:
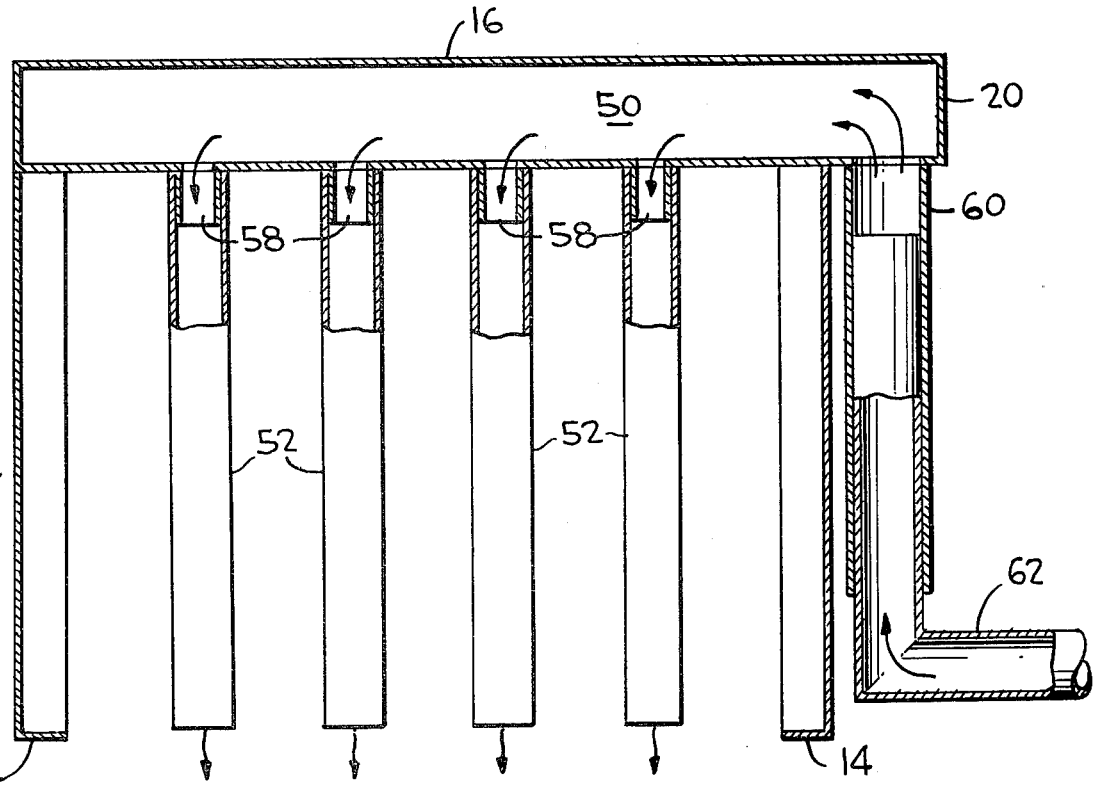
FIG. 7 is a horizontal cross-sectional view taken on the line 7—7 of FIG. 4.

A shortlog-retaining rod 38, which may be square in cross-section as shown, has its lower end seated in each of the slots 36 and is welded into an upwardly and outwardly inclined oblique angular position. Four of these rods are located at the four corners of the grill. Each of the intermediate rods, which are eight in number, four in each of the grill front and rear members 30, 32, in the illustrated example, are equally spaced apart laterally along the members, and the slots 36 in which these four rods are seated provide inwardly and oppositely open pockets whose sides are formed by the cuts in the members and whose backs are formed by the sloping surfaces of the seated rods, all as shown in FIGS. 2 and 6.

The grill is completed by a series of grate bars extending from front to rear in laterally equidistantly spaced parallelism. A grill having six pairs of rods 38, like the illustrated example of the invention, will have two fixed end grate bars, each formed by one of the grill members 34, and four intermediate grate bars 40. Each of these intermediate bars is made removable from the grill, having its ends chamfered to fit loosely in the angular pockets formed by the slots snugly up against the sloping surfaces of the rods 38. FIG. 1 shows the bars 40 in operative position, and FIG. 2 shows them lifted out of the slots and removed.

The grill 12 is mounted in horizontal operative position on the lower frame 10, with the rear and end members of the grill seated respectively on the rear and end members of the lower frame. The grill and lower frame are connected in this superposed relation in such a way that the front of the grill can be lifted to and beyond the angular position shown in broken lines in FIG. 3, without lateral shift of the grill. This is accomplished by connecting the grill and lower frame by hinges 46 (see FIGS. 3, 5 and 6) welded or otherwise affixed to the vertically aligned back faces of the grill and lower frame rear members.

In the preferred, FIGS. 1–7 embodiment of the invention, the back member 16 of the lower frame is a hollow box element that serves as a manifold 50 to supply relatively cold room air to a plurality of tubes 52 extending from rear to front of the grate for heating by logs burning on the grill and discharge from the front ends of the tubes into the room.

For this purpose the front member 30 of the grill has a series of brackets 54 welded in depending relation to its under surface directly beneath the front end portions of the intermediate grate bars 40. These brackets constitute hangers for receiving and holding the front end portions of the tubes 52, which are best made square in cross-section, of sheet metal and of appropriate length to have their rear ends sleeved over nipples 58 projecting from the manifold and their open front ends extending well beyond the front of the grill.

The extended end 20 of the combination lower frame rear member and manifold has a short supply tube 60 projecting forwardly and receiving, in telescoped extensible relation, the end portion of a right-angular tube 62 which may be connected to the output of a small electric motor powered blower assembly 64 (see FIGS. 2, 3 and 4), as by a flexible hose (not shown) so that the assembly may be positioned within the hearth or outside it, in the room in the case of installations in existing hearths, or within the building wall in the case of new installations.

Figure 5:
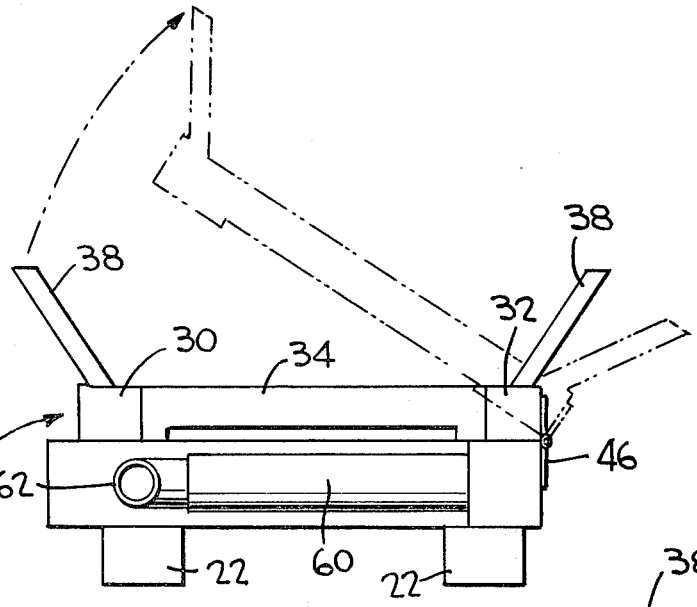
FIG. 5 is an end elevational view of the same grate, showing the grill in broken lines in elevated position.

It will be evident from the foregoing that the air tubes 52, when in the operative position shown in FIG. 1, with their rear ends sleeved on the nipples 58 of the manifold, function (1) to secure the grill (from which the tubes are hung by the brackets 54) rigidly to the lower frame (to whose rear member manifold the tubes are keyed by interfit with the nipples), (2) to receive air from the manifold for heating by the fire on and under the grill and discharge the heated air into the room, either at a moderate rate of delivery when the supply tube 60 is not connected to the blower or at a higher rate when the tube is connected and the blower is operating, and (3) that the tubes can be withdrawn from the nipples just enough to free the grill for manual lifting, using one of the projecting tubes as a handle, to and beyond the broken line position shown in FIG. 5, to facilitate removal of ashes through the wide open front of the grate structure.

It will be evident also that ready removability of the air tubes 52 makes it possible to form the tubes of simple sheet metal stock which is sufficiently thin to be highly efficient in conducting heat to the contained air and is inexpensive for replacement of tubes burned out from excessive heat exposure.

it will also be evident that the grate bars 40 (1) are readily removable for replacement if and whenever required by warping or for any other reason, and (2) constitute the sole and entire support for the logs, thus serving the important purpose of protecting the relatively thin-walled air tubes 52 from direct contact with the burning logs while exposing them closely to the heat radiated from the logs, from the embers and hot ashes on the floor of the hearth, and from the grate bars.

The FIGS. 8 and 9 modification of the invention is basically similar to the FIGS. 1–7 embodiment hereinabove described in respect of the hinged relation of a completely rectangular grill and a U-shaped three-sided lower frame, but differs in lacking the air tube feature.

Figure 8:
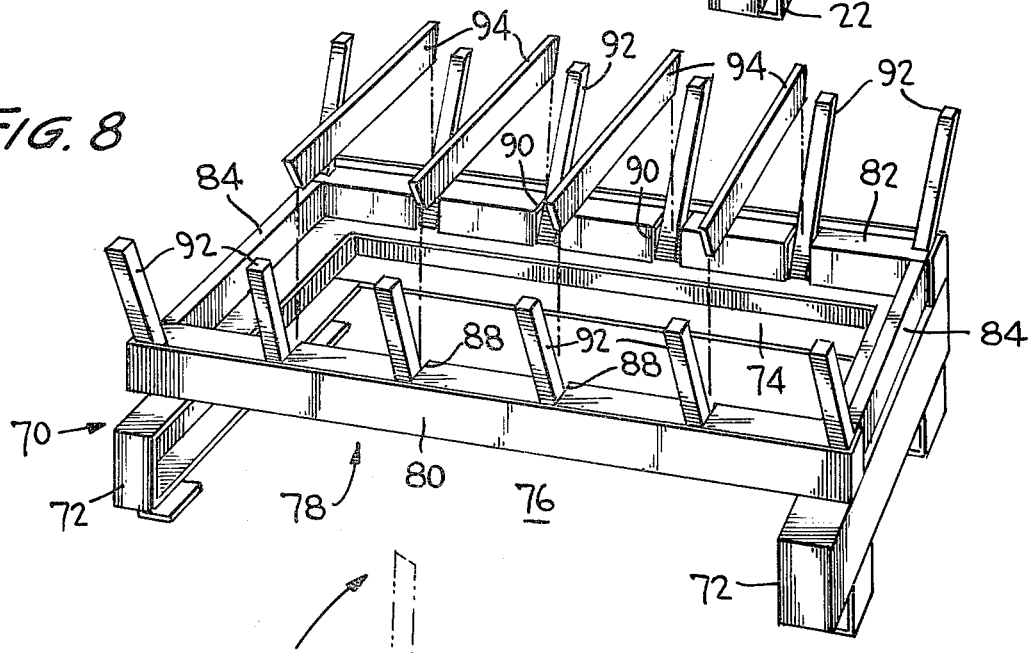
FIG. 8 is a perspective, exploded view, similar to that of FIG. 2, but showing a modified, less complete embodiment of the invention.
Figure 9:
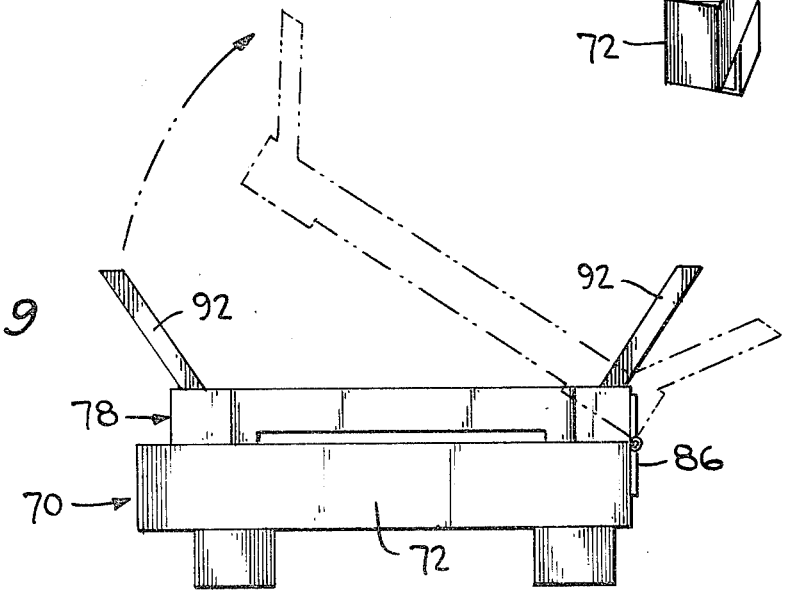
FIG. 9 is an end elevational view, similar to that of FIG. 3, but showing the grate of FIG. 8.

Thus the simpler and less expensive grate of FIGS. 8 and 9 comprises a lower frame component 70, made up of two end members 72 connected by a back member 74 to form a fixed frame that is U-shaped in plan, with a wide open front 76. But the back member 74 is not a manifold and need not be tubular, it being necessary only that it present a top surface coplanar with the top surfaces of the end members to provide bearing for the grill element 78, and that it be properly designed for hinged connection to the grill.

The grill 78 is four-sided, i.e., rectangular in plan, made up of a front member 80, a back member 82, and end members 84 connecting the two. The back member is hinged at 86 to the back member 74 of the lower frame. Its lower surfaces bear on the lower frame, and it can be tilted up to and beyond the position shown in broken lines in FIG. 9 to facilitate ash removal through the open front 76 of the grate, as in the first described embodiment. The intermediate portions of the grill members 80 and 86 are slotted at 88 and 90 respectively; the log-retaining rod elements 92 are welded in position in these slots and to the end members 84; and the slots in the intermediate portions of the members are oppositely open for removable seating of the chamfered ends of grate bars 94.

While two specific modifications of the invention have been used in this specification to exemplify presently preferred embodiments of the inventive principles, it is to be understood that others are contemplated within the broad scope of the appended claims.

I claim:

1. A fireplace grate comprising a lower supporting frame and a grill mounted thereon, said lower frame being U-shaped in plan, being formed of opposed side members connected by a transversely extending rear member and having an open front, said grill being of rectangular shape in plan, being as wide as the lower frame and formed of opposed side members connected at their ends by transversely extending one-piece front and rear members which are co-planar with the side members, and a plurality of log-supporting grate bars extending from said front to said rear member of the grill in parallel laterally spaced relation, and said grill rear member being hinged directly to said lower frame rear member, whereby the entire grill is tiltable unitarily from an operative lowered horizontal position in which only the lower frame side members bear the grill side members to an inoperative raised rearwardly inclined position facilitating removal of ashes forwardly through the unobstructed open front of the lower frame.

2. A fireplace grate comprising the structure claimed in claim 1 in which the front and rear members of the grill are formed with aligned upwardly open slots, and the opposite ends of each grate bar are removably seated in each pair of aligned slots for upward-lifting therefrom.

3. A fireplace grate comprising a lower supporting frame and a grill mounted thereon, said lower frame comprising a transversely extending rear member and a pair of side members extending forwardly from the ends of the rear member, said lower frame rear member being a tubular manifold open at one end for air input and closed at its opposite end, a plurality of laterally spaced forwardly extending parallel tubes having rear ends connected to said manifold for reception of air therefrom and having front ends open for discharge of said air, and a plurality of grate bars carried by said grill in forwardly extending laterally spaced parallelism, each overlying one of said tubes, the grill includes a transversely extending rear member hinged directly to the rear member of the lower frame, whereby the front end of the grill may be tilted upwardly from it normal position bearing on the lower frame whereby air passing from said manifold for discharge from the front ends of said tubes may be heated by logs burning on said grill and by hot embers dropped therefrom.

4. A fireplace grate as claimed in claim 3 in which the lower frame is substantially U-shaped in plan, having an open front, and the grill includes a rear member hinged directly to the rear member of the lower frame, whereby the grill may be tilted upwardly from its normal position bearing on the lower frame side members, with removal of ashes forwardly from the hearth facilitated by the open front of the lower frame.

5. A fireplace grate as claimed in claim 3 in which the grill includes front and rear members having upwardly open slots aligned in pairs receiving the grate bars for removable lifting therefrom.

6. A fireplace grate as claimed in claim 3 in which the grill includes front and rear members, the tubular manifold of the lower frame includes a plurality of forwardly projecting nipples, and each of said tubes has its rear end removably telescoped on one of said nipples and its front end slidably bracketed to the under surface of the front member of the grill.

7. A fireplace grate as claimed in claim 3 in which the grill includes a transversely extending front member and a transversely extending rear member hinged to the rear member of the lower frame for upward tilting of the grill from its normal position bearing on the lower frame, the tubular manifold of the lower frame includes a plurality of forwardly projecting nipples, the front member of the grill is provided with a plurality of tube-hanging brackets depending from its bottom, and each of said tubes has its opposite ends removably mounted respectively in one of said brackets and on one of said nipples for securing the grill against upward tilting when the tubes are in mounted position, whereby the tubes can be withdrawn from the nipples to permit said tilting.

8. A fireplace grate as claimed in claim 3 in which the grill includes transversely extending front and rear members, each having upwardly open slots for removable reception of the grate bars, the tubular manifold of the lower frame includes a plurality of forwardly projecting nipples, and each of said tubes has its rear end removably telescoped on one of said nipples and its front end slidably bracketed to the under surface of the front member of the grill.

9. A fireplace grate as claimed in claim 3 in which the lower frame is substantially U-shaped in plan, having an open front end, and the grill includes a rear member hinged to the rear member of the lower frame, whereby the grill may be tilted upwardly from its normal position bearing on the lower frame, with removal of ashes forwardly from the hearth being thereby facilitated by the open front of the lower frame, the tubular manifold of the lower frame includes a plurality of forwardly projecting nipples, the front member of the grill is provided with a plurality of tube-hanging brackets depending from its bottom, each of said tubes has its opposite ends removably mounted respectively in one of said brackets and on one of said nipples for securing the grill against upward tilting when the tubes are in mounted position, and the tubes are slidable through the brackets for withdrawal from the nipples to free the grill for upward tilting and removal of ashes forwardly through the open front of the lower frame, and the grill includes transversely extending front and rear members, each having upwardly open slots for removable reception of the grate bars, whereby the grate bars overlie the tubes in protective relation while exposing the tubes to heat from logs on the grill and embers below it.

10. A fireplace grate comprising a lower supporting frame and a grill mounted thereon, said lower frame consisting of a transversely extending rear member and a pair of side members extending right-angularly from the ends of the rear member and forming therewith a U-shaped structure the front of which is entirely open between the front ends of the side members, the lower frame rear member being a tubular manifold open at one end for air input and closed at its opposite end, a plurality of tubes extending forwardly in laterally spaced parallelism from removable connection of their rear ends to the manifold for receiving air therefrom and having their front ends open for discharge of said air, and said grill comprising transversely extending front and rear members connected at their ends to forwardly extending side members and forming therewith a rectangular structure the side members of which bear on the side members of the lower frame, brackets slidably hanging the front end portions of the tubes from the front member of the grill, and the rear member of the grill being hinged to the manifold, whereby the tubes secure the grill down in operative position on the lower frame and the tubes are slidable forwardly in the brackets for removal from the manifold, thereby freeing the grill to swinging to upwardly tilted inoperative position facilitating removal of ashes through the open front of the lower frame.

11. A fireplace grate as claimed in claim 10 in which the grill includes a plurality of grate bars each extending forwardly from the rear member of the grill to the front member of the grill and overlying one of said tubes for supporting logs on the grill.

12. A fireplace grate as claimed in claim 11 in which the front and rear members of the grill have upwardly open slots aligned in pairs, and said grate bars are removably mounted in said slots.

* * * * *